US005483909A

United States Patent [19]

Nogueras

[11] Patent Number: 5,483,909

[45] Date of Patent: Jan. 16, 1996

[54] METHOD AND APPARATUS FOR SEWING THE PERIMETER SEAM OF AN UPHOLSTERED OR TRIMMED ARTICLE

[75] Inventor: Jose L. A. Nogueras, Madrid, Spain

[73] Assignee: Fabricas Lucia Antonio Betere, S.A. (Flabesa), Madrid, Spain

[21] Appl. No.: 331,220

[22] Filed: Oct. 28, 1994

[30] Foreign Application Priority Data

Oct. 29, 1993 [ES] Spain ..... 9302271

[51] Int. Cl.[6] ..... D05B 11/00

[52] U.S. Cl. ..... 112/475.04; 112/2.1; 112/470.27

[58] Field of Search ..... 112/2.1, 10, 62, 112/121.15, 121.23, 143, 157, 308, 309, 306, 262.3; 108/1, 6; 104/242, 245; 198/465.2, 346.1

[56] References Cited

U.S. PATENT DOCUMENTS

| | | | |
|---|---|---|---|
| 1,322,842 | 11/1919 | Sutton | 112/2.1 |
| 2,063,521 | 12/1936 | O'Brien | 112/2.1 |
| 3,083,654 | 4/1963 | Cash, Sr. | 112/2.1 |
| 3,664,280 | 5/1972 | Redman et al. | 112/2.1 |
| 4,043,282 | 8/1977 | Fanghanel | 112/2.1 |
| 5,127,336 | 7/1992 | Wakabayashi | 104/245 X |
| 5,363,785 | 11/1994 | Conley, Jr. | 112/262.3 X |

FOREIGN PATENT DOCUMENTS

| | | | |
|---|---|---|---|
| 4063658 | 2/1982 | Japan | 198/346.1 |

*Primary Examiner*—C. D. Crowder
*Assistant Examiner*—Ismael Izaguirre
*Attorney, Agent, or Firm*—Peter L. Michaelson; Jeffery J. Brosemer

[57] ABSTRACT

A method and apparatus for sewing the perimeter seam of an upholstered or trimmed article whereby the article is positioned upon a table having a planar sliding surface and a sewing machine located adjacent one side of the table. The table is variably adjustable at an incline between 0 and 90 degrees relative to horizontal so that when an article is placed on the planar surface, normal gravitational forces acting on the article force that article towards the sewing machine thereby facilitating the handling and introduction of the article to the sewing machine.

9 Claims, 2 Drawing Sheets

METHOD AND APPARATUS FOR SEWING THE PERIMETER SEAM OF AN UPHOLSTERED OR TRIMMED ARTICLE

OBJECT OF THE INVENTION

The object of the present invention is to provide a method and apparatus for sewing the perimeter seam of an upholstered or trimmed article, i.e., mattresses.

BACKGROUND OF THE INVENTION

Various methods and apparatus are used commercially to sew upholstered articles. European Pat. No. 89200451.6 discloses a "Sewing device for mattresses or cushions". This European Patent describes a device, intended for sewing the edges of a mattress, consisting of a mobile support surface, a sewing machine, and an oscillating arm, which in cooperation with control elements rotate the mattress around one of the corners of the mattress while the mattress is being sewed. The device also uses sensors that detect the position of the mattress, as well as a control unit which activates a pneumatically driven oscillating arm. The pneumatically driven oscillating arm is activated as a result of signals issued by the sensors and received by the control unit.

Spanish Patent No. 9100056 which is attributable to the applicants of the present invention describes a "System for the sewing of trimmed units". The apparatus described in this patent consists of a sewing machine affixed to one side of a table, a variable speed reducer motor connected to a transmission unit which, in turn drives a conveyor belt placed upon the table on which is placed a mattress. Through the use of the variable speed reducer motor, three different sewing speeds are provided. The particular sewing speed used is dependent upon the portion of the mattress which is being sewn. Sensors such as photoelectric cells, provide information about the current position of the mattress and that information is used to select an appropriate sewing speed. The highest sewing speed is intended for sewing straight sections, a slower speed is used at the end of these straight sections when approaching corners, and a third speed is for sewing the corners. An electrically activated arm that rotates the mattress during the sewing of the curves is also described in this patent.

Spanish Patent no. 9301374, also attributable to the applicants of the present invention, describes a "Process for the handling and sewing the perimeter of trimmed units". This patent describes a sewing method and apparatus that utilizes linear and arcuate pusher element both of which protrude through the plane of a table. Through the longitudinal action of the linear pusher elements and the arcuate action of the arcuate pusher elements, a mattress or other article is pushed through a sewing machine. The linear pusher elements and arcuate pusher elements are driven by a drive means located below the plane of the table.

SUMMARY OF THE INVENTION

This invention provides a method and apparatus for sewing the perimeter of an upholstered article such as a mattress. The method and apparatus is functionally simpler than similar methods and apparatus known in the art while providing superior sewn characteristics to the finished article.

The method and apparatus which is the object of the invention, includes a table with a sewing machine affixed to one of the sides of the table. The table includes a highly polished top surface on which the article to be sewn slides. The table is further distinguished in that the top surface of the table is variably positionable at an incline of between 0 and 90 degrees relative to horizontal. When the table is positioned at an incline, with the sewing machine located on the side of the table at the bottom of the incline, the article which rests upon the polished table is directed to the sewing machine by normal gravitational forces acting upon the article. Such positioning of the article facilitates the handling and introduction of the article to the sewing machine.

The article being sewn is advanced by the action of several linear pusher elements which project from the plane of the table through several longitudinal grooves cut in the surface of the table. The linear pushers are driven by a driving means located beneath the surface of the table. When driven, the linear pushers advance and push the article across the surface of the table and through the sewing machine which continuously sews the perimeter seam of the article until a corner of the article reaches the sewing machine. When a corner of the article reaches the sewing machine, the linear pusher elements are driven back to their initial position and/or retracted beneath the surface of the table.

When the article reaches the position in which a corner of the article meets the sewing machine, a rotation activating unit rotates the article by approximately 90 degrees while the corner of the article is continuously sewn by the sewing machine. The rotation activating unit is formed by a combination of opposing arcuate pushers and arcuate retainers that act in concert. These arcuate pushers and arcuate retainers protrude through arcuate grooves cut in the surface of the table. The arcuate pusher grooves extend from the side of the table supporting the sewing machine counterclockwise toward the table. The arcuate retainer grooves extend from the side of the table supporting the sewing machine clockwise toward the table. Both the arcuate pushers and arcuate retainers are driven by a driving means located beneath the surface of the table. When the corner of an article is located beneath the sewing machine and the arcuate pushers and arcuate retainers are activated, the arcuate pushers and arcuate retainers contact two sides of the article that are perpendicular to one another or at approximately a 90 degree angle to one another.

Through the opposite and synchronized operation of the arcuate pushers and arcuate retainers, the article being sewn is securely held between the arcuate pusher and arcuate retainer while the article is simultaneously turned approximately 90 degrees. The arcuate pushers push the article in a counterclockwise arcuate path away from the edge of the table supporting the sewing machine while the arcuate retainers support the article in a clockwise arcuate path toward the edge of the table supporting the sewing machine. This operation of the arcuate pushers and arcuate retainers turns the article while the sewing machine sews the corner seam of the article. When the corner seam of the article is completely sewn, the arcuate pushers and arcuate retainers are withdrawn to their initial position and/or retracted beneath the surface of the table, and the linear pushers again become operational.

The linear pushers, arcuate pushers and arcuate retainers may be retracted beneath the surface of the table. Alternatively, the linear pushers may be driven to their original position adjacent to one edge of the table and the arcuate pushers and arcuate retainers driven to the edge of the table adjacent to the sewing machine. Such retraction or placement frees the sliding surface of pushers and retainers so that the article which is to be sewn is freely movable about the sliding surface.

Additionally, the linear pushers, arcuate pushers and arcuate retainers may be mounted on jointed endless belts or chains, so that only some of the pushers or retainers project through the sliding surface, whereas the others remain concealed beneath the sliding surface.

Both the linear pushers and the rotation activation unit formed by a combination of arcuate pushers and arcuate retainers as well as the means for driving all of them, may be mounted on a single movable carriage, which in turn is mounted beneath the surface on which the article to be sewn slides.

Other features and advantages of the present invention will be appreciated by those skilled in the art upon reading the detailed description which follows.

BRIEF DESCRIPTION OF THE DRAWINGS

The teachings of the present invention can be readily understood by considering the following detailed description in conjunction with the accompanying drawings, in which.

DETAILED DESCRIPTION OF A PREFERRED FORM OF THE INVENTION

I will now describe the preferred embodiment of the invention while referring to the figures, both of which may be simultaneously referred to during the course of the following description.

Figure 1:
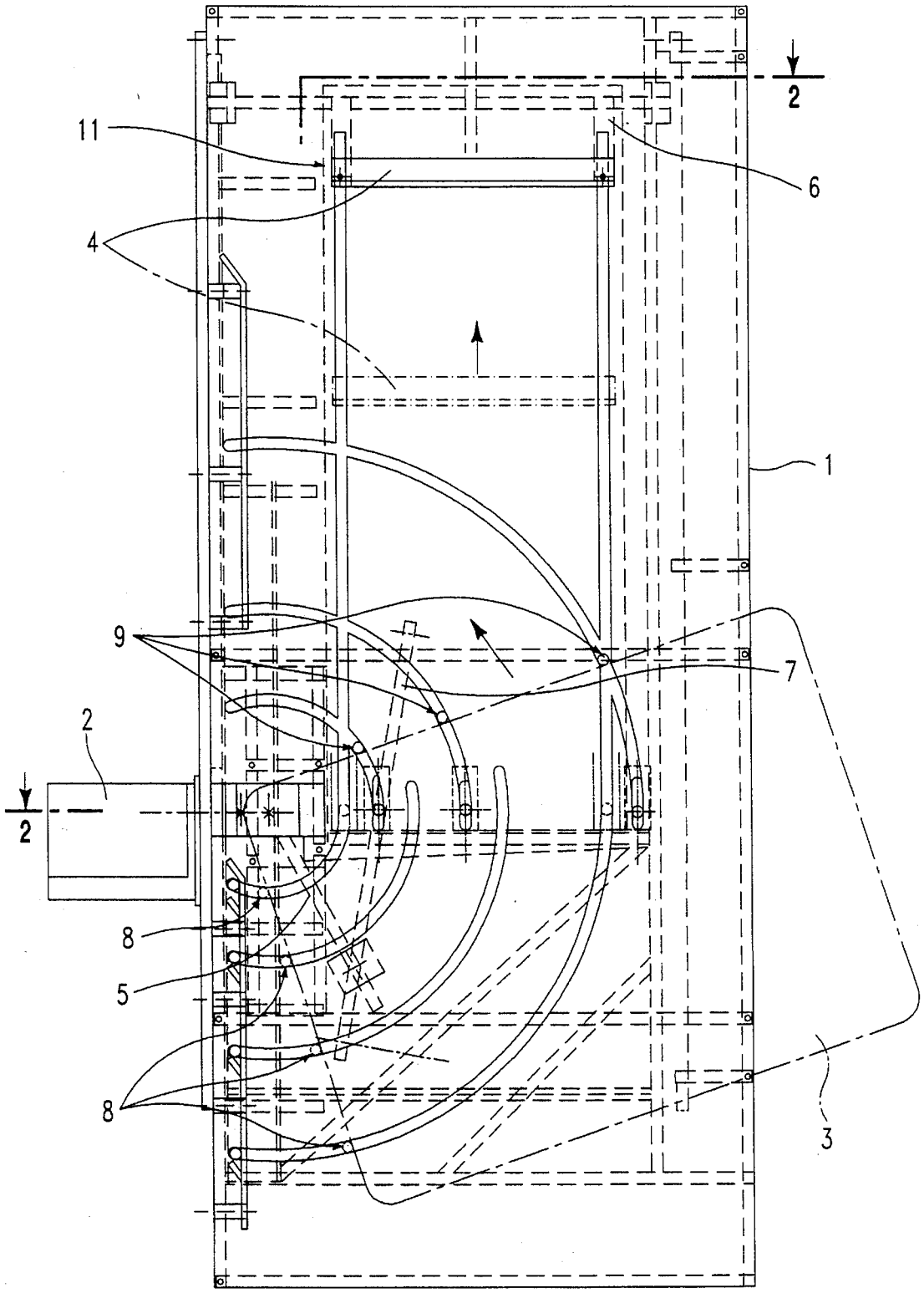
FIG. 1 shows an upper plan view of the invention.

FIG. 1 shows an overhead or plan view of a sliding table 1, onto which sewing machine 2 is attached to one of the sides of the table.

Figure 2:
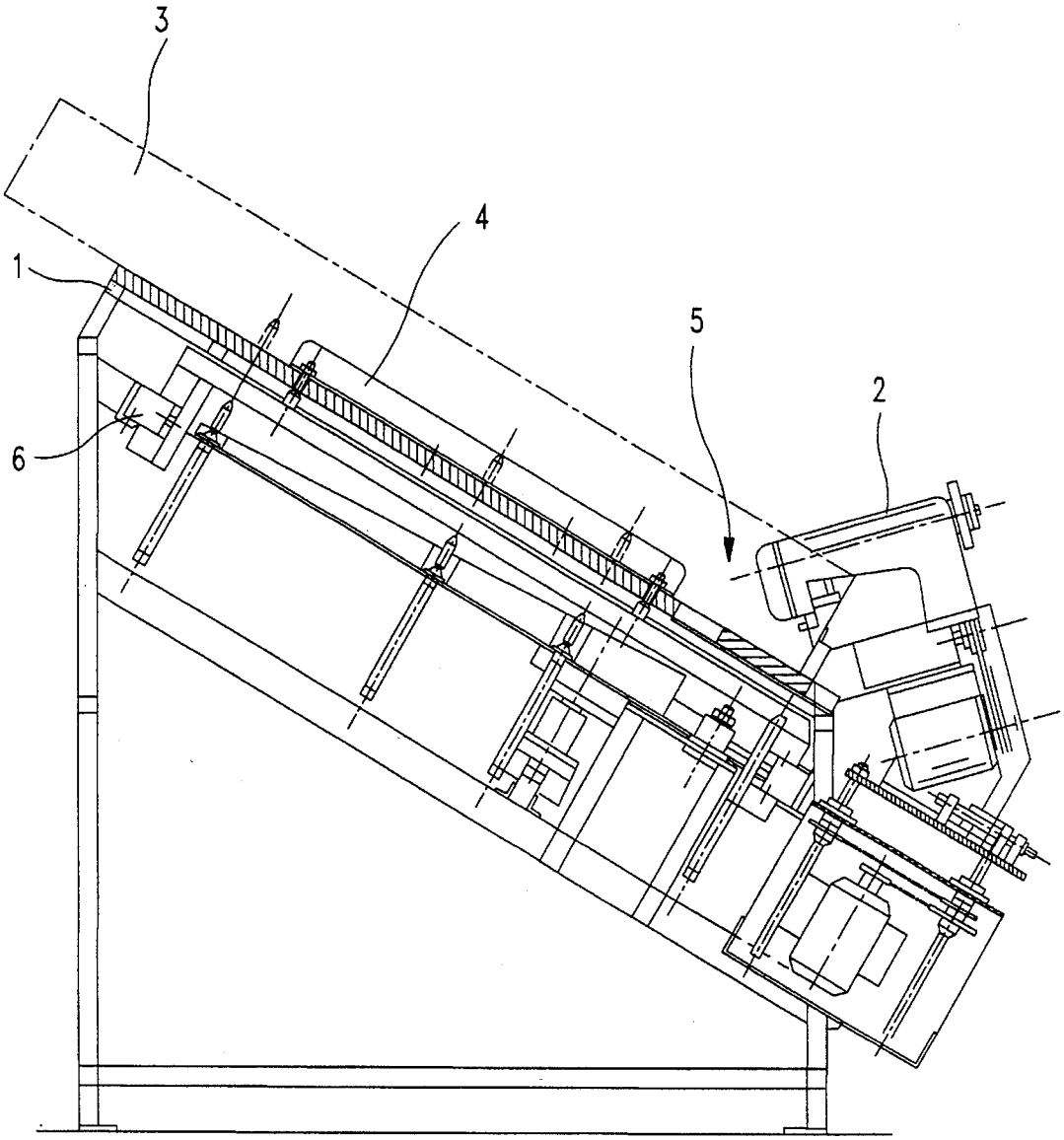
FIG. 2 shows a side view of the invention along the direction indicated by A—A in the above FIG. 1.

Sliding table 1 has, for its topmost surface, a polished surface over which an article to be sewn 3 slides with minimal friction. Sliding table 1 is inclined between 0 and 90 degrees to horizontal, as shown in FIG. 2, in order for the article to be sewn to approach the sewing head of the sewing machine 2 through the effect of gravitational forces, thereby facilitating introduction of article 3 to the sewing machine 2.

The article 3 is pushed in a longitudinal direction along the surface of the sliding table 1 by linear pushers 4. The linear pushers 4, project from the plane of the table through several longitudinal grooves cut in the surface of the table. The linear pushers 4 advance in a longitudinal direction toward the sewing machine 2 and push the article 3 until a corner of the article is positioned beneath the sewing machine 2. The linear pushers 4 then withdraw to their initial position or alternatively, are retracted beneath the sliding surface of the table 1.

When article 3 is located in the position in which a corner of the article is beneath the sewing machine 2, rotation activation unit 5, comprised of opposing arcuate pushers 8 and arcuate retainers 9 which project from the plane of table 1 through arcuate grooves in the surface of the table 1, causes article 3 to rotate by about 90 degrees, while said sewing machine 2 sews the corner of the article 3 in a synchronized manner. That is, the corner of the article 3 is sewn by the sewing machine 2 while the article is turned by the rotation activation unit 5.

Those skilled in the art can readily appreciate that linear pushers 4 and the arcuate pushers 8 and arcuate retainers 9 of rotation activation unit 5 may be retractable, thereby allowing them to be concealed beneath the plane of the sliding surface by their retraction perpendicular to the surface of the table. Alternatively, the longitudinal pushers 4 and arcuate retainers and arcuate pushers may be driven to sides of the table 1. When the pushers and retainers are retracted or driven to the sides of the table, the sliding surface of the table 1 is free, thereby permitting easy movement of the article 3 to be sewn.

Rotation activation unit 5, comprising arcuate pushers 8 and arcuate retainers 9, may be driven axially by linear traction device 7, or by some other driving means, i.e., electrical or pneumatic, so as to cause the arcuate pushers 8 and arcuate retainers 9 to move in an arcuate path; the arcuate pushers 8 moving away from the side of the table supporting the sewing machine 2 and the arcuate retainers 9 moving toward the side of the table 1 supporting the sewing machine 2.

Through the operation of the rotation activation device 5, comprising arcuate pushers 8 and arcuate retainers 9, the article 3 to be sewn may be pushed in an arcuate path so that a corner of the article 3, may be sewn by the action of sewing machine 2.

The linear pushers 4 and the arcuate pushers 8 and arcuate retainers 9 of rotation activation unit 5 may be mounted on jointed endless belts or chains, shown in FIG. 1 as 11, so that only some of the pushers project from the sliding surface of the table 1, whereas others remain concealed beneath the sliding surface of the table 1.

The linear pushers 4 and rotation activation unit 5 comprising arcuate pushers 8 and arcuate retainers 9, may be mounted on single carriage 6, which moves beneath the sliding surface of the table on which article 3 slides.

Through the use of the invention of the present application, the perimeter seam of an upholstered article is sewn in a perfectly synchronized way, including rounded corners, while obtaining results substantially superior to the prior art. Clearly, it should now be quite evident to those skilled in the art, that while my invention is shown and described in detail in the context of a preferred embodiment, and with various modifications thereto, a wide variety of other modifications can be made without departing from the scope of my inventive teachings.

I claim:

1. A method for sewing the perimeter seam of an upholstered article comprising the steps of:

(a) extending a plurality of linear pusher elements through longitudinal grooves of a planar, sliding surface of a table;

(b) positioning said planar surface of said table at an incline from 0 to 90 degrees from horizontal;

(c) moving said linear pusher elements in a rectilinear direction from an initial position until said linear pusher elements contact an upholstered article positioned upon said planar surface of said table;

(d) moving said linear pusher elements along a length of said grooves in a rectilinear direction such that said upholstered article is moved in a rectilinear direction;

(e) sewing a seam in said upholstered article with said sewing machine as said upholstered article is being moved by said linear pusher elements;

(f) stopping said movement of said linear pusher elements when a corner of said upholstered article reaches said sewing machine;

(g) moving said linear pusher elements to its said initial position;

(h) moving a plurality of arcuate pusher elements and a plurality of arcuate retainer elements, which protrude from arcuate grooves in said table, in an arcuate path while said arcuate pusher elements and said arcuate retainer elements contact said upholstered article such that said upholstered article is turned in an arcuate path away from said sewing machine and towards said table in a counter-clockwise direction; and (i) sewing a corner seam in said upholstered article while said article is being turned by said arcuate pusher elements and arcuate retainer elements.

2. The method of claim 1 further comprising the steps of:

(j) retracting said linear pusher elements to a position beneath the planar surface of said table; and (k) retracting said arcuate pushers and arcuate retainers to a position beneath the planar surface of said table.

3. Apparatus for sewing the perimeter seam of an upholstered article comprising:

a table having a planar, sliding surface with longitudinal and arcuate grooves in said surface, said table being variably positionable at an incline from 0 to 90 degrees from horizontal;

a sewing machine located adjacent one side of said table;

a plurality of linear pusher elements that protrude through said longitudinal grooves in said planar surface of said table such that said linear pusher elements contact an upholstered article positioned upon said planar surface of said table;

means for driving said linear pusher elements from an initial position along a length of said grooves in a rectilinear direction such that said upholstered article is moved in a rectilinear direction while a seam is sewn in said upholstered article;

means for stopping the movement of said linear pusher elements when a corner of said upholstered article reaches said sewing machine; and means for driving a rotation activation unit, said rotation activation unit comprising arcuate pusher elements and arcuate retainer elements, said arcuate pusher elements and arcuate retainer elements protrude through said arcuate grooves in said planar surface of said table and contact said upholstered article such that a corner seam in said upholstered article is sewn while said upholstered article is being turned in an arcuate path away from said sewing machine and towards said table in a counter-clockwise direction.

4. The apparatus of claim 3 wherein said rotation activation unit that comprises arcuate pusher elements and arcuate retainer elements is driven by a driving means positioned beneath the surface of said table.

5. The apparatus of claim 3 wherein said linear pusher elements are mounted on a jointed endless belt or chain.

6. The apparatus of claim 3 wherein said arcuate pusher elements and arcuate retainer elements are mounted on a jointed endless belt or chain.

7. The apparatus of claim 3 wherein said linear pushers and said rotation activation unit comprising arcuate pusher elements and arcuate retainer elements are mounted on a single, movable carriage which moves beneath the planar surface of said table.

8. The apparatus of claim 3 further comprising a means for retracting said linear pusher elements to a position beneath the planar surface of the table.

9. The apparatus of claim 8 further comprising a means for retracting said arcuate pusher elements and said arcuate retainer elements to a position beneath the planar surface of the table.

* * * * *